US005899335A

United States Patent [19]

Boyer et al.

[11] Patent Number: 5,899,335

[45] Date of Patent: May 4, 1999

[54] MEDICATION CONTAINER AND METHOD OF USING

[76] Inventors: Mildred E. Boyer, 6910 Tipp-Cowlesville Rd., Tipp City, Ohio 54371; Marinus B. Bosma, 5125 Studebaker Rd., Tipp City, Ohio 45371

[21] Appl. No.: 08/889,057

[22] Filed: Jul. 7, 1997

[51] Int. Cl.[6] ..... B65D 83/04

[52] U.S. Cl. ..... 206/538; 116/308; 206/534; 220/524

[58] Field of Search ..... 116/308; 206/534, 206/538, 539; 40/324; 220/524

[56] References Cited

U.S. PATENT DOCUMENTS

| | | | |
|---|---|---|---|
| 1,717,060 | 6/1929 | Mottayaw | 206/534 X |
| 2,953,242 | 9/1960 | Shaw | 206/534 |
| 3,596,629 | 8/1971 | English | 206/534 X |
| 3,744,672 | 7/1973 | Dangles et al. | 206/534 X |
| 3,926,335 | 12/1975 | Dangles et al. | 206/534 X |
| 4,053,054 | 10/1977 | Lucas | 206/534 |

FOREIGN PATENT DOCUMENTS

| | | | |
|---|---|---|---|
| 2635507 | 2/1990 | France | 206/534 |
| 2133091 | 7/1971 | Germany | 206/538 |

*Primary Examiner*—Bryon P. Gehman
*Attorney, Agent, or Firm*—William Weigl

[57] ABSTRACT

A container for medications, written instructions and other materials is provided for an individual whose cognitive powers may be diminished and who must take several medications or doses at different times of a day. The container takes the annular array form of a clock face with hourly positions having either or both visual and/or Braille indicia. Each hourly position has a separate lid-covered compartment for placement therein of medications or instructions to be taken within designated hours. The containers are provided in pairs, one being designated for ante meridiem hours and the other for post meridiem hours. They may be alternately arranged coaxially with a clock having either an hour hand or a blocking shutter, the latter of which insures that only the lid of a given compartment is accessible at the designated time for taking a specific medication. Pairs of containers sufficient for a week's medications can be organized, filled and stacked for successive use. The system enables monitoring by a care giver to assure that medications have been taken.

7 Claims, 1 Drawing Sheet

MEDICATION CONTAINER AND METHOD OF USING

This invention relates to a system and method for assuring that an individual requiring periodic replenishment of specific medication receives it at the proper times of day and in the proper dosage. Although the system is useful by anyone requiring medication, including home use for one's self, its most beneficial use is in connection with patient care where the patient has no or may have only limited cognitive capabilities.

BACKGROUND OF THE INVENTION

A variety of devices are available for personal use by individuals for taking prescribed medications. Most common are those which have one compartment for each day of the week, commencing with a Sunday and going through the following Saturday. Other units are available for supplying different pills or a quantity of the same pills for a single day. One such unit has a resettable count-down timer and battery-operated alarm for indicating that a predetermined time has passed since taking the last medication, and that it is time to take another dose. Some systems have a way of distinguishing ante meridiem (AM) from post meridiem (PM) times of the day and some use Braille identifying means for the sightless. These systems are quite acceptable in instances where an individual is capable of discerning which medication or the proper dose of a specific medicine to take. But in some instances, such as in the case of a person suffering from Alzheimer's disease, e.g., such a system can be confusing for the person to self-administer the medication. It can even be somewhat confusing for a care giver of that person, particularly where many different medications are required at various times of day. In other instances such as in a hospital where medications are under control of multiple nurses who administer to the same patient, care must be taken to assure that proper medication is timely taken and in the proper dosage. Safeguards have been developed to provide patient protection in the latter such instance, but even these safeguards can stand improvement.

Time-related dispensers are known for other uses, as well. For example, an indexable 96 hour clock can be set to expose five different bowls of cat food on a daily basis when a cat is left alone in a house for a prolonged period during which no one is around to feed it. Similarly, timed dispensers are known for feeding fish at preselected times.

SUMMARY OF THE INVENTION

A container for organizing and monitoring the taking of medications and reviewing of written instructions and other materials is provided for an individual whose cognitive powers may be diminished and who must take several medications or doses at different times of a day. The container takes an annular array form of a clock face with hourly positions having either or both visual and/or Braille indicia. Each hourly position has a separate lid-covered compartment for placement therein of medications or instructions to be taken within designated hourly periods. In one form of the invention, the containers are provided in pairs, one being designated for AM hours and the other for PM hours. The AM and PM units are used sequentially as stand-alone items or they can be arranged coaxially with a clock having either an hour hand or a blocking shutter. The shutter has an opening which insures that only the cover or lid of a given compartment is accessible at the designated time for taking a specific medication. The clock may be an off-the-shelf unit having a Geneva drive mechanism which indexes the shutter in hourly increments and preferably A sounds an alarm to indicate that the time for taking a medication or reading a reminder message has arrived. With such a Geneva drive, each hour's compartment is successively accessible for only one hour. Pairs of containers sufficient for a week's medications can be supplied, filled and stacked for successive use by a care giver, particularly in instances where the patient cannot be entrusted to properly fill the various compartments and organize the system in a manner which allows accurate monitoring. Taking of the wrong medication, or taking the right medication at the wrong time or in the wrong dosage can be harmful, even fatal in some instances.

A principal object of the invention is to provide a system and method for assuring that an individual relying on medication receives the proper medication in the proper dosage at the appropriate time of day, as required by a the prescriber.

Another object is to provide a method for organizing and monitoring the taking of medications through use of the disclosed containers.

A further object is to provide a medication container having a geometric clocklike configuration which is familiar to an individual whose short term memory is diminished, but who is capable of remembering how to "tell time" from an ordinary analog clock. More specifically, the system is designed with compartments arranged in the form of a clock face to enable a person of somewhat diminished capacity to self-administer his or her medication. For a person of greatly diminished capacity, the compartments can be associated with an actual clock which has means for inhibiting access to all compartments but that compartment which has reached the time of day in which it is to be made accessible.

Still another object is to enable use of the system and method by a staff of care givers in situations where more than one person may be caring for a specific individual, and there is need to monitor that a required medication has been administered at the proper time.

A further object is to provide care givers with a virtual presence in the daily life of a patient through administering medication, and instructing and encouraging the patient while using the system of the invention.

Other objects and advantage will become apparent from the following description, in which reference is made to the accompanying drawings.

DESCRIPTION OF THE PREFERRED EMBODIMENT

Figure 4:
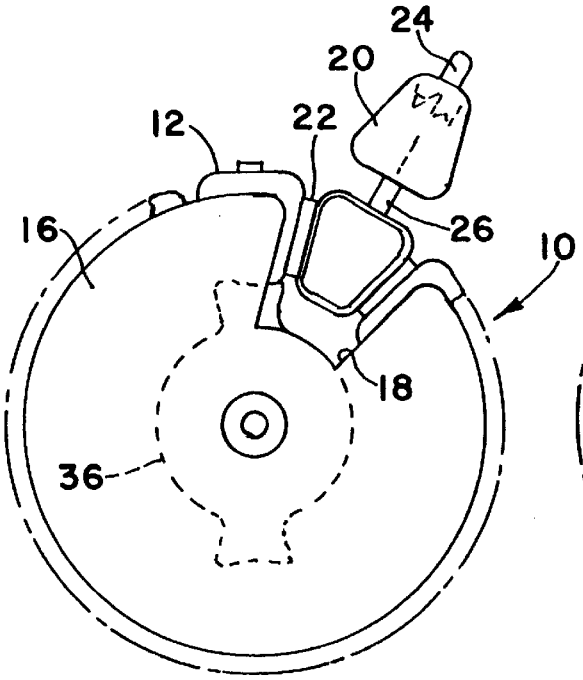
FIG. 4 is a fragmentary frontal view of the array arranged with a clock having a blocking shutter for enabling access to only one compartment at any given time.
Figure 3:
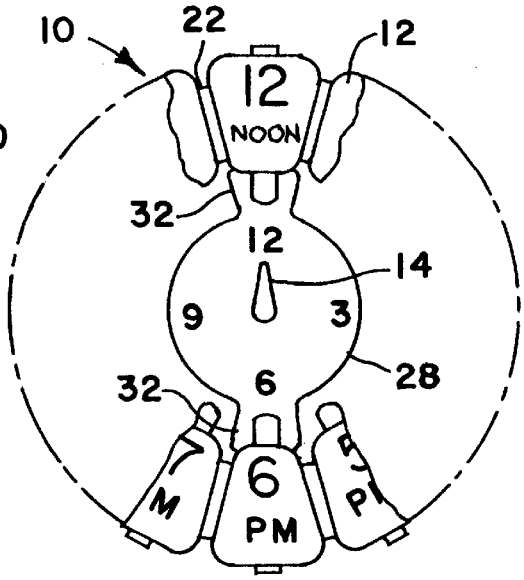
FIG. 3 is a fragmentary frontal view of the container arranged for use with a clock having an hour hand.

The system and method about to be described are intended primarily for use in connection with individuals who need assistance in the taking of medications, but they are useful also by any individual who is perfectly capable of taking care of himself or herself without any assistance. Perhaps every individual recognizes that simple distractions can easily cause one to forget whether or not he or she has taken or forgotten to take a specific medication when required. The system takes two primary forms. In its most simple and least expensive form, a container 10 includes an annular array of twelve discrete compartments 12 arranged in clockwise fashion and numbered corresponding to the twelve hourly positions of a clock. In its more elaborate and necessarily more expensive form, the container is associated with a special clock, either one with an hour hand 14 as shown in FIG. 3 or one with a blocking shutter 16 having an opening 18 as shown in FIG. 4. The compartments are equidistantly spaced thirty degrees apart when used in conjunction with a clock, but need not be so spaced when used as a stand alone unit, i.e., not in relation to a clock mechanism. The system and method will only be described in relation to the combination of clock and container.

American Druggist Magazine stated in its Jan. 10, 1994 issue that "the chief reason that people don't take their medications is poor communications between health care providers—doctors, pharmacists, nurses and physician's assistants—and patients". Even though the communications are adequate, however, and even if the medications are organized in compartments of a container by a competent care giver, if the person using the container is unable to decipher which compartment to open and at what time, problems can and probably will arise.

Although the invention is useful in different situations for individuals of differing mental capabilities, it is being described hereinafter for use in self-administering medication by an Alzheimer's patient, although a care giver is required to fill the container according to the patient's needs. Obviously, the communications from the prescriber cannot be given directly to the patient, but must be directed to an intermediary who in turn sees to it that the medication is administered at the proper time in the proper dosage. To do otherwise is asking for problems. Particularly if the patient requires medication several times throughout a day, near-constant watchfulness may ordinarily be necessary. Many such patients will suffer from loss of short term memory, but can retain long term memory, such for example as knowing how to tell time by or viewing an analog clock. Having done that since childhood, they can oftentimes continue to relate to a clock face although they may be unable to associate that clock face or the time itself with anything going on about them. For example, if a patient's normal lunch hour is 12:00 noon, his or her seeing a clock indicate 12:00 may not have any significance. But if an alarm alerts the patient that something is required to be done, by viewing a clock and container together or in sequence, the patient can know to go to the container compartment corresponding to the time shown on the clock face. Thus, as will be seen, for a person suffering from Alzheimer's, the clock face configuration of the container enables a care giver to not only assist in the self-administration of drugs, but can also be used to instruct the patient to do certain acts that may have been forgotten, such as eating lunch, watching a favorite TV show, taking a shower, taking a nap, going to bed, replacing the container with an other, etc. A side benefit of proper use of the invention in conjunction with a clock is the freedom available to the care giver to attend to other matters instead of devoting full or near-full time to the patient. In effect, then, utilization of our invention enables the patient to care for himself or herself in administering the medication, although it still requires that a care giver organize the medications and instructions in the container in the first instance.

Figure 2:
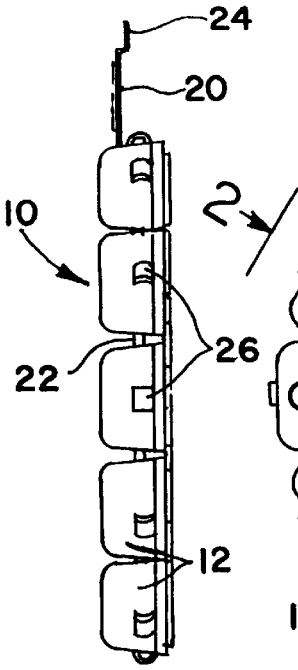
FIG. 2 is a side view of the container of FIG. 1, taken looking essentially in the direction of the arrow 2 of FIG.
Figure 1:
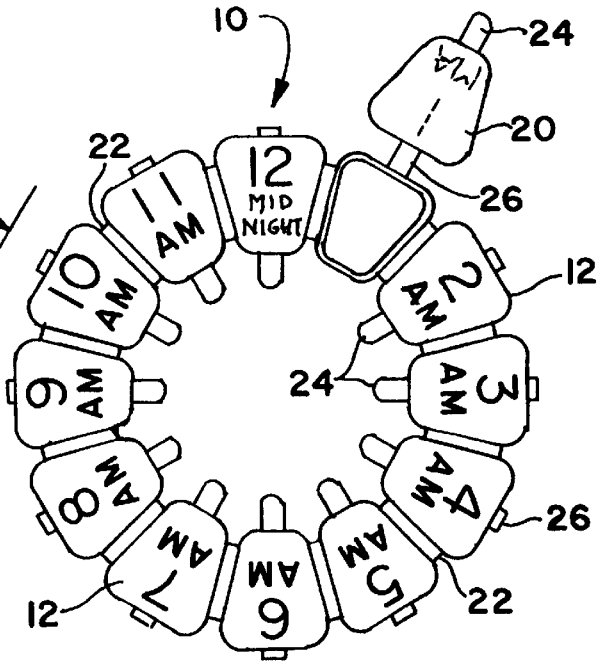
FIG. 1 is a frontal or plan view of a container having an annular array of medication compartments numbered like that of an analog clock.

The container 10 FIGS. 1 and 2 is a molded, one-piece transparent or translucent plastic unit, with each compartment 12 having its own cover or lid 20. The compartments are interconnected by flat webs 22 and are each provided with a pull tab 24. To open a compartment, a tab 24 is grasped and lifted away from its compartment 12 to pivot about a living hinge 26. The array is numbered for the twelve hours of a day. Since there are actually twenty-four hours in a day, the arrays are provided in pairs and are alternated in use. The units of each pair are distinguished for AM and PM hours hours in some manner, preferably by having the AM unit being light or white in color, and the PM unit being dark or black. The care giver (or if the patient is capable), must change the units from one to the other at appropriate times. Obviously, they do not have to be changed only at midnight and noon but probably ought to be done at bedtime and noon. This means, of course, that if bedtime is 10:00 PM, the next light-colored container of the pair must also be aligned with a clock hand 14 or shutter opening 18 at the 10:00 o'clock position, even though it is the AM container. Any of several techniques of affixing the clocks and containers is feasible, the one illustrated being in the form of diametrically opposing yokes 32 which anchor to the inner ends of any two opposing compartments 12. It is assumed in the just-described illustration that no further medication is required in the PM hours of the day, so the morning's container may be installed, provided it be done to make the container and clock hand or shutter correspond appropriately.

The form of the combined clock and container shown in FIG. 1 may be used where there is no concern that the patient requires safeguards to assure that only the proper container is opened when an appropriate alarm is sounded. The alarm may be part of the clocks 28 and 30 or may be separate timer alarms carried by the individual on a necklace, bracelet or in a pocket, An independent timer is preferred if the patient is permitted to move about, away from the vicinity of the clock, such as outdoors, but it is felt desirable to always also include a simple alarm integral with the clock itself.

The version of our invention shown in FIG. 4 has a built-in safeguard which assures that only a specific compartment 12 is accessible at the appropriate time for taking of a medication or receiving an instruction. The clock 30 may be an off-the-shelf type which is driven by a Geneva mechanism. The shutter 16 is indexed incrementally only at the change of an hour, without movement of the shutter between the hourly positions. Once an hour is reached, the alarm sounds, and the patient then has up to one hour in which to retrieve the contents of the exposed compartment before the unit indexes to the next hourly position. The shutter may be held in place on the shaft of the clock by a thumb nut in instances where the clock has to be connected to a container from its back because of the protrusion of the yokes 32. Preferably, the design should be one which enables the clock 30 with shutter intact to be placed over the container 12, but need not be. This arrangement is feasible where the tabs 24 are located at the outside edge of the array and hinged at one of the other sides of the compartments.

Figure 5:
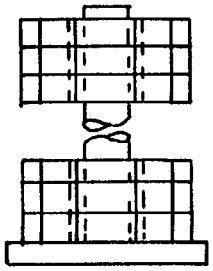
FIG. 5 is a simplified elevational view of a stack of the units of FIG. 1, sufficient to allow placement of medications thereinto for multiple days, as long as a week.

FIG. 5 is a simplified illustration of one method of stacking multiple containers alternating between AM and PM units. For example, a care giver may organize fourteen containers to satisfy the needs of a patient for an entire week, placing Sunday AM at the top, Sunday PM second from the top and proceeding through the week to Saturday PM. When using the compartments for instructions as well as medications, those instructions may differ from one day to the next during the week, making use of enough containers for the whole week highly desirable. Additionally, some medications may be required on alternate days, again making a full week's containers preferred. The units may be made to nest, or they can be mounted over a cylinder (as shown in FIG. 5) or inside a cylindrical or square box.

Various changes may be made without departing from the spirit and scope of our invention. For example, the compartments may also have Braille and/or luminous indicia for use by the sightless or taking of medication in the dark. In addition, it can be noted that the numbers from 1 through 12 in FIG. 1 are arranged with the base of each number being toward the center of the unit. While this is quite acceptable for use by a discerning individual as a stand alone unit, it would be unacceptable for an Alzheimer's patient, because the 6 would appear to be a 9 because of its being upside down. As seen in FIG. 3, all of the numbers are shown with their bottoms facing a table or stand on which the clock may be mounted, which is conventional for an analog clock which has its numbers displayed. Although no stand has been illustrated, one could be readily provided.

Having described our invention, we claim:

1. A set of containers comprising two annular arrays of twelve discrete compartments each arranged circumferentially to simulate hour positions on the face of a twelve hour clock while providing space for temporary retention of at least one article in at least a selected said compartment, one of said set of containers being provided with distinguishing characteristics indicative of the first twelve hours of a day from midnight to noon and the other of said set of containers being provided with distinguishing characteristics indicative of daylight hours from noon to midnight;

each compartment of each container comprising a bottom wall on one side of said array and a plurality of side walls normal to said bottom wall, all of said bottom walls lying in the same plane and constituting a generally planar back side of said container;

the side walls of each compartment of each container being of the same depth and being directed from said planar back side toward an opposite front side of each container;

each said compartment of each container further including a closable cover having a hinge connected to a side wall thereof and a finger-grippable tab protruding radially with respect to each cover and being positioned opposite the hinge of the respective compartment;

an operative twelve hour clock having means for consecutively mounting each annular array in turn relative to said clock whereby the clock hourly positions are arranged to align with corresponding tabs of each compartment; and numerical indicia on the outer side of each cover, said indicia being consecutively arranged in a clockwise direction to simulate the hours of a twelve hour clock on each container of said set.

2. The invention according to claim 1 wherein said one container is of a light color representative of ante meridiem hours and said other container is of a dark color representative of post meridiem hours.

3. The invention set forth in claim 1 wherein said clock includes a blocking shutter driven by said clock and adjacent the front side of a respective one of said containers, said shutter having an opening for uncovering one compartment at a time, the uncovered compartment corresponding to an hourly setting of said clock to unblock each compartment at a designated time for enabling access thereto.

4. A method for assuring that medications are provided at appropriate times for an individual whose short term memory may be diminished or impaired but whose faculty for knowing the time of day from the face of a clock is unimpaired, said method including the steps of:

providing at least one pair of first and second annular containers each having twelve discrete coverable compartments arranged circumferentially to simulate twelve hourly positions of a face of a clock;

marking said compartments with indicia consecutively arranged clockwise to simulate the twelve hours of an analog clock;

providing said first container with a distinguishing characteristic indicating ante meridiem hours of the day from midnight through noon;

providing said second container with a distinguishing characteristic indicating post meridiem hours of the day from noon through midnight;

based on scheduled times for taking predetermined medications, placing the predetermined medications in appropriate compartments of said containers in accordance with the individual's need; and removing the contents of each compartment at appropriate times in accordance with the time of day.

5. The method according to claim 4 including the additional steps of providing a central opening in each said container, providing an analog clock for placement within either opening and correspondingly aligning a readout of said clock with appropriate indicia marked on said compartments, and alternately placing either said first or second container in cooperative relationship with said clock in accordance with the post meridiem or ante meridiem time of day.

6. The method according to claim 4 wherein seven sets of said first and second containers are provided to accommodate different hourly timings of requiring medications for different days of the week, loading the compartments of said seven sets of containers and organizing the pairs of containers for each day to assure that each set is used on the appropriate day of the week.

7. The method according to claim 6 including the step of providing means for enabling vertical stackability of said containers one atop another, and wherein said organizing includes stacking the containers from top to bottom in consecutive order of the days of the week.

* * * * *